US005773095A

United States Patent [19]

Coker

[11] Patent Number: 5,773,095

[45] Date of Patent: Jun. 30, 1998

[54] METHOD FOR A REDUCING THE STRINGING OF ADHESIVE FROM AN APPLICATOR

[75] Inventor: William R. Coker, Lilburn, Ga.

[73] Assignee: Nordson Corporation, Westlake, Ohio

[21] Appl. No.: 726,924

[22] Filed: Oct. 7, 1996

[51] Int. Cl.[6] ..... B05D 1/02

[52] U.S. Cl. ..... 427/424; 118/323; 118/677; 118/680; 118/686; 156/578; 427/207.1; 427/208.4

[58] Field of Search ..... 427/424, 207.1, 427/208.4; 118/677, 680, 686, 323, 324; 493/128, 129, 131; 156/578

[56] References Cited

U.S. PATENT DOCUMENTS 3,348,519 10/1967 Dyess, Jr. et al. ..... 118/669
4,009,498 3/1977 Staats et al. .
4,010,203 3/1977 Aylon ..... 118/680 X
4,484,850 11/1984 Shimizu .
5,401,791 3/1995 Milks .

*Primary Examiner*—Jeff H. Aftergut
*Attorney, Agent, or Firm*—Roger D. Emerson, Esq.

[57] ABSTRACT

An apparatus (10) and method for reducing stringing of adhesive from a nozzle (20) of a dispensing apparatus (12) includes a pneumatically driven cylinder (50) which translates the source of adhesive co-linear with the translating substrate (100). The gun (14) is alternately translated at speeds equal to or greater than the substrate (100), with the object of causing the string (102) of adhesive to fall back onto the substrate (100) in a desired location rather than become airborne and fly away to undesirable locations.

4 Claims, 5 Drawing Sheets

METHOD FOR A REDUCING THE STRINGING OF ADHESIVE FROM AN APPLICATOR

BACKGROUND OF THE INVENTION

1. Field of the Invention

This invention pertains to the art of apparatuses and methods of dispensing materials, and more particularly to apparatuses and methods to address the problem of adhesive stringing between the substrate and the dispensing apparatus after the application of adhesive has ended.

2. Description of the Related Art

In a wide variety of businesses and manufacturing operations, it is often desirable for an apparatus to dispense a material, commonly an adhesive material, to a target area on a moving substrate. This operation is typically carried out in an automatic manner in order to speed manufacturing, reduce costs and improve accuracy.

The invention can be utilized in any situation in which a material is being deposited on a substrate from a nozzle, but is especially applicable to the situation where the material is an adhesive. Examples of an adhesive application to a substrate include sealing boxes or applying adhesive to the binding of a book during a bookbinding operation. Box-sealing and bookbinding manufacturing operations typically employ a conveyor-style method of applying an adhesive. The device applying the adhesive is often an extrusion gun which applies adhesive for a predetermined time to the substrate, which is moving on a conveyor. The extrusion gun is then turned off and the flow of the adhesive is stopped by closing the nozzle of the extrusion gun. The problem to which the invention is directed occurs at this point in the process. Although the nozzle of the extrusion gun is closed, a string of adhesive can be drawn from the nozzle. The string of adhesive is lengthened and stretched by the movement of the substrate away from the nozzle. As the substrate continues to move away from the nozzle, the string of adhesive eventually breaks.

The string of adhesive is now troublesome in the manufacturing process. Because it has been stretched and thinned by the relative movement between the substrate and the nozzle, the string is wispy and easily transported through the air. This can lead to a messy production area requiring clean-up time or the fouling of equipment, thereby hindering production time and contaminating pristine substrate surfaces and other similar problems.

Although many inventions such as air knives and snuff back devices have addressed this problem, further improvements were desirable.

Accordingly, the primary object of this invention is to provide a method and apparatus to address the problem of adhesive stringing.

Another object of this invention is to provide an apparatus that is easily installed on various associated apparatuses.

Another object of this invention is to provide a method and apparatus reducing or eliminating the requirement of an expensive adhesive to eliminate the problem of stringing.

The invention will be described in detail with reference to the accompanying drawings.

SUMMARY OF THE INVENTION

The present invention contemplates an apparatus designed to work with any dispensing apparatus. The inventive cut-off apparatus consists of rails to support and a cylinder to move an associated dispensing gun in a horizontal plane over a substrate which is also moving. After the gun has dispensed adhesive on the moving substrate and the gun is closed, such as by operation of a needle and associated seat, the gun is moved in the same direction as the moving substrate but at a greater speed, thereby breaking any adhesive string from the nozzle of the gun and causing it to fall back onto the target area.

According to another embodiment of the invention, the extrusion gun can follow the path of the substrate in either direction and in multiple planes. The path of the adhesive upon the substrate can lie in different planes, thus not limiting the path of the extrusion gun. This extrusion gun path can be accomplished by a variety of different means and is not limited to any specific path nor plane.

According to another embodiment of the invention, the inventive cut-off apparatus includes a pneumatic cylinder to move the gun along with the substrate.

Still further benefits and advantages of the invention will be apparent to those skilled in the art to which it pertains upon the reading and understanding of the following detailed specification and description.

DESCRIPTION OF THE DRAWINGS

The invention will take form in certain parts and arrangements of parts. The preferred embodiment will be described in detail and will be illustrated in the following drawings which form a part of this disclosure and wherein.

DETAILED DESCRIPTION OF THE PREFERRED EMBODIMENT

Figure 1:
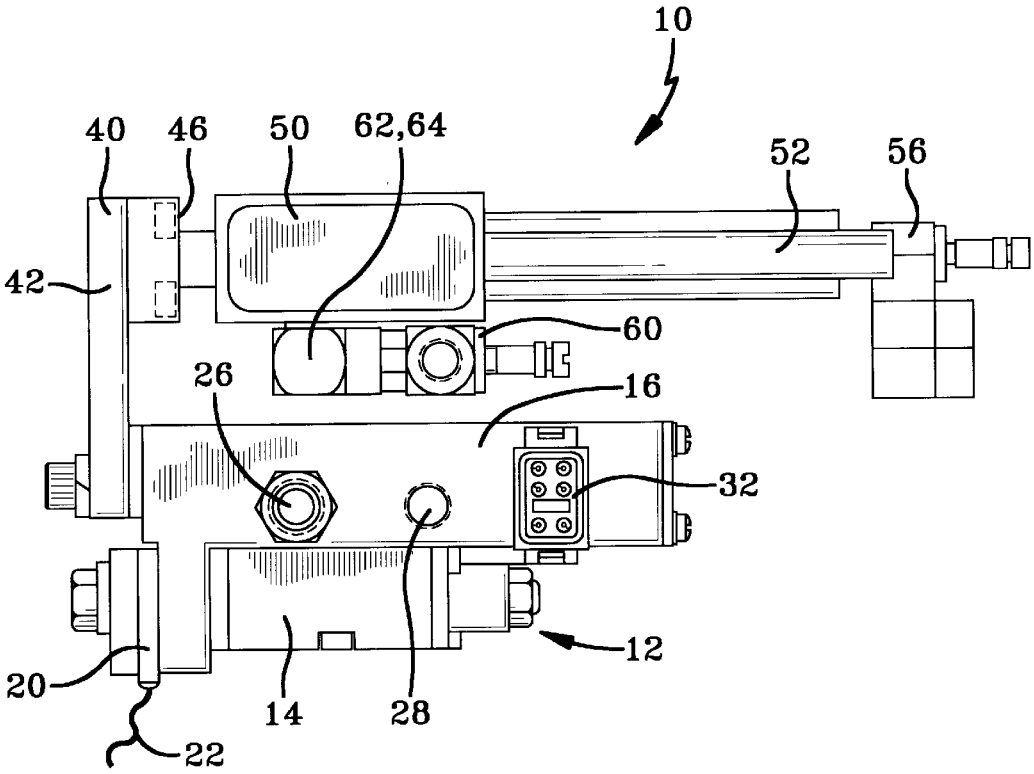
FIG. 1 is a front view of the inventive cut-off apparatus shown in a first position.
Figure 2:
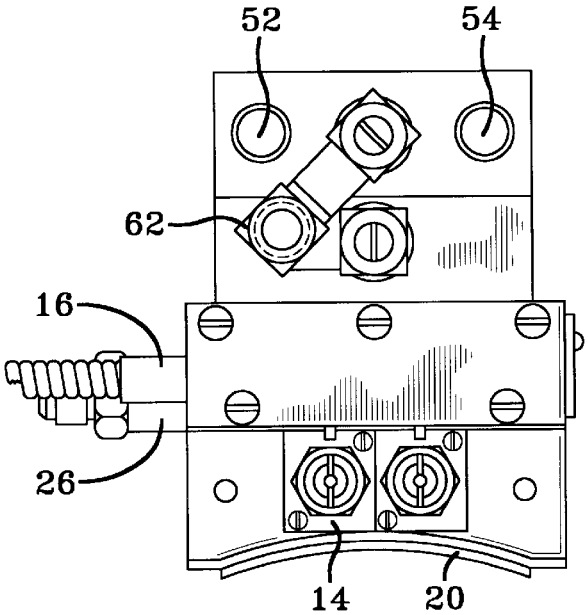
FIG. 2 is a side view of the inventive cut-off apparatus illustrated in FIG. 1.

Referring now to FIGS. 1 and 2, the inventive cut-off apparatus 10 is illustrated as being used in conjunction with an associated extrusion device 12. The extrusion device 12 is of those known in the art to dispense hot-melt adhesives, such as an H200 dispensing gun manufactured by Nordson Corporation of Amherst, Ohio. The extrusion device 12 includes gun 14, manifold 16, and nozzle 20. The material to be applied, such as adhesive 22, is dispensed from the nozzle 20. The extrusion device 12 is typically pneumatically powered. Adhesive is generally supplied to the manifold 16 through conduit 26 while compressed air is introduced through conduit 28. The device illustrated is especially suitable for use with thermoplastic materials, such as hot melt adhesives. The hot melt adhesive is maintained in a liquid state by heaters which receive their electrical energy via port 32. The operation of the extrusion device is known in the art. As stated previously, the cut-off apparatus 10 can be used with other associated devices, but will be described with reference to the extrusion of hot-melt adhesives by an extrusion device 12 distributing the adhesive over a substrate.

With continuing reference to FIGS. 1 and 2, the inventive cut-off apparatus 10 will be described. The cut-off apparatus 10 includes a mounting plate 40 to which the associated extrusion device 12 is mounted. The mounting plate 40 is attached to a first end 42 of the cut-off apparatus 10. The mounting plate 40 is attached to end block 46 which is attached to the cylinder assembly body 50. First and second rails 52,54 extend from the cylinder assembly body 50 to end member 56. The movement of the mounting plate 40, the end member 56, and the rails 52,54 is effected by pneumatic pressure regulated by valve means 60. In the preferred embodiment, the valve means 60 includes a first and second valve and flow control units 62,64 which are powered by compressed air.

In the embodiment illustrated, the cylinder assembly body 50 mounts the cut-off apparatus 10 to an associated apparatus (not shown), such as a frame, robot, or other structure which can support the extrusion device 12. As such, the cylinder assembly body 50 remains stationary throughout the preferred process. The mounting plate 40 and end member 56 move along with rails 52,54 in response to the stroke of the cylinder assembly 50.

As a substrate 100 moves under the nozzle 20 at a certain velocity, the extrusion device 12 is activated by an associated control or sensing means which is not shown but which is known in the art. By means discussed above, adhesive 22 flows from the nozzle 20 onto the substrate 100. As the substrate 100 reaches a predetermined position where the bead 106 of adhesive is no longer desired, the flow of adhesive is stopped. When the flow of adhesive is stopped, the adhesive suspended between the nozzle 20 and the substrate 100 is temporarily adhered to the nozzle 20 and a string of adhesive can form.

However, movement of extrusion device 12, mounting plate 40, rails 52,54 and end member 56 is now activated by the associated control or sensing means, preferably following the same path of the substrate and at a speed equal to, or preferably greater than, that of the substrate. This forces the tailing string to break and fall back onto the existing bead 106. The apparatus 12 then returns to its initial position and the process repeated. The cylinder assembly body 50 remains stationary and acts as a stabilizing guide during the movement. The stroke of the cylinder assembly body 50 is dependent on factors unique to each application, such as viscosity and break strength of the material being dispensed, speed of the gun, speed of the substrate, length of the target area, etc. The speed of the gun and length of stroke can be determined with reference to these factors and the application of sound engineering practice within the state of the art.

With reference to FIGS. 3–10, the inventive method will now be illustrated and contrasted with the prior art method.

Figure 3:
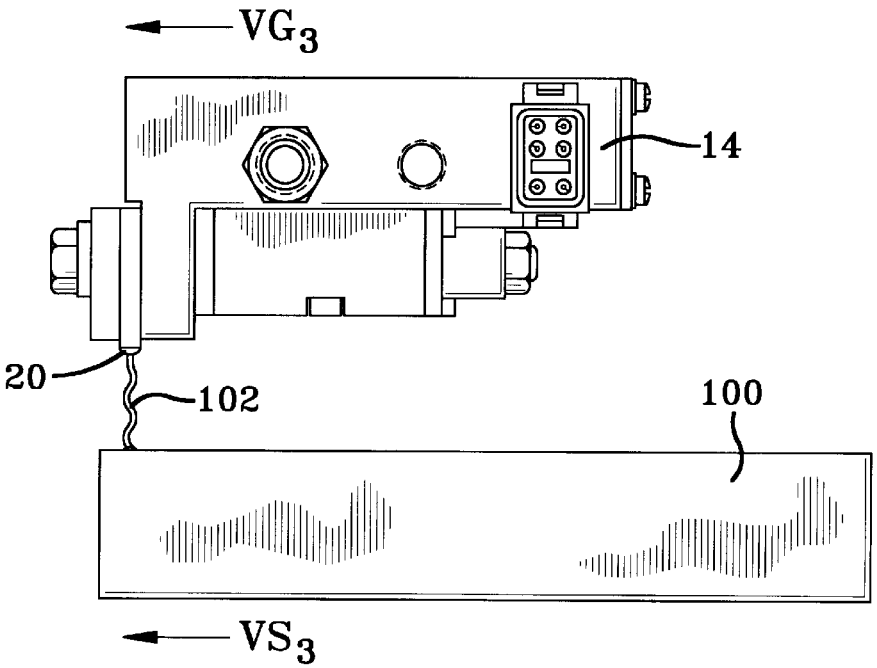
FIGS. 3–6 illustrate prior art methods of applying a bead of material to a substrate.

With reference to FIG. 3–6, the prior art systems included a substrate 100 moving at a velocity VS, a gun 14 moving at a velocity VG, and a string 102 of adhesive. In FIG. 3, the substrate 100 moves at a positive velocity VS3 and the gun 14 is stationary, meaning VG3 is zero. ("Positive" means traveling from the right side of the Figure to the left side.) Throughout FIGS. 3–6, VS is positive velocity and VG is equal to zero.

Figure 4:
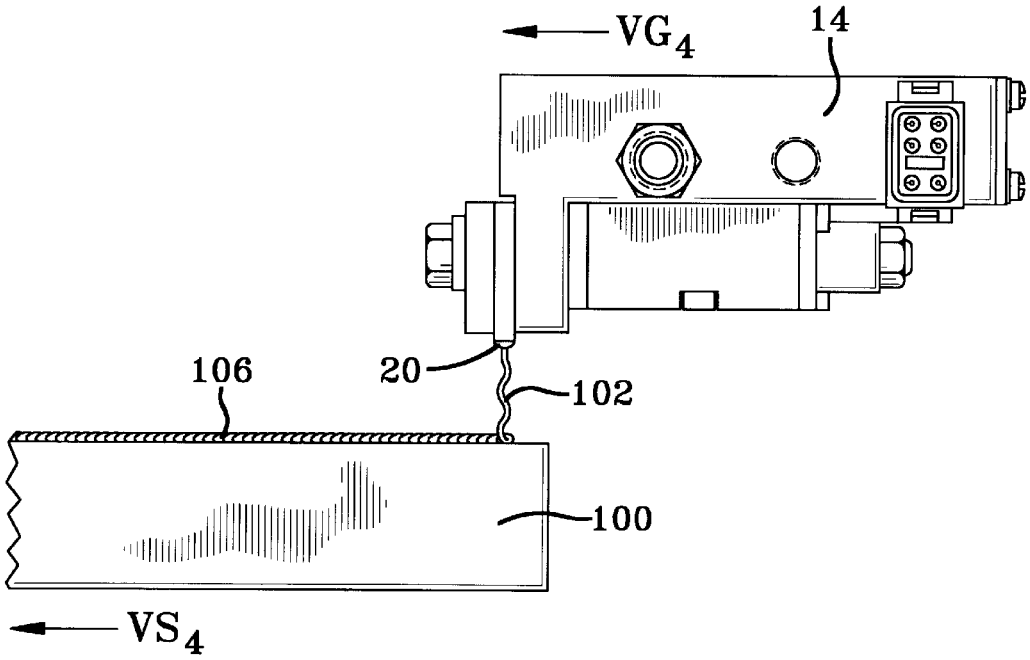

With reference to FIG. 4, after a period of time, due to the difference between VS4 and VG4, a bead 106 of adhesive is laid on the substrate 100. At this point, the nozzle 20 of the gun 14 is closed, cutting of the flow of adhesive.

Figure 5:
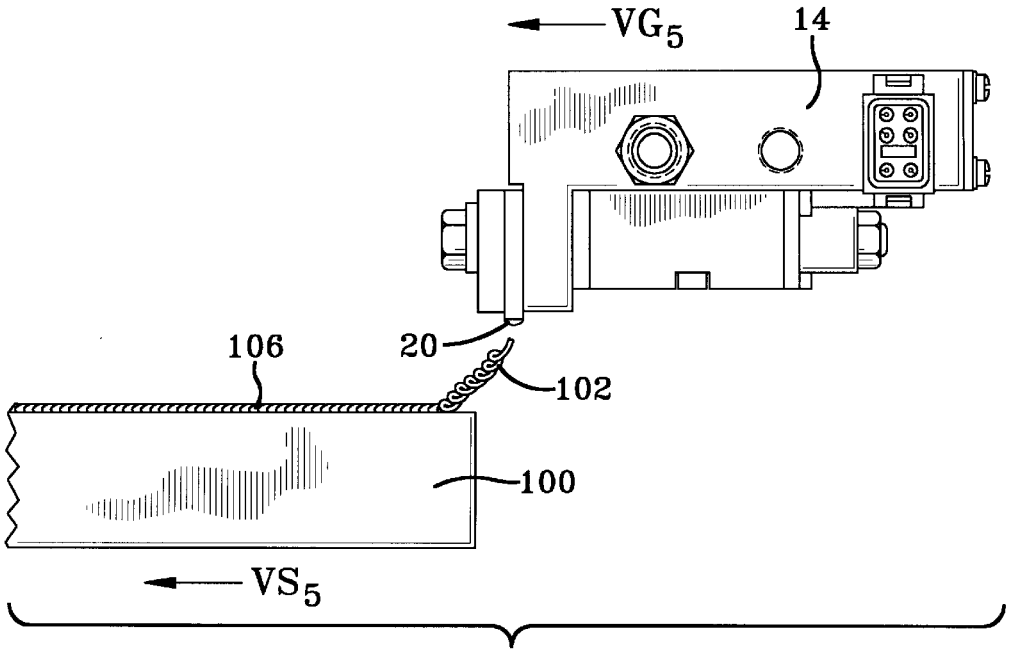
Figure 6:
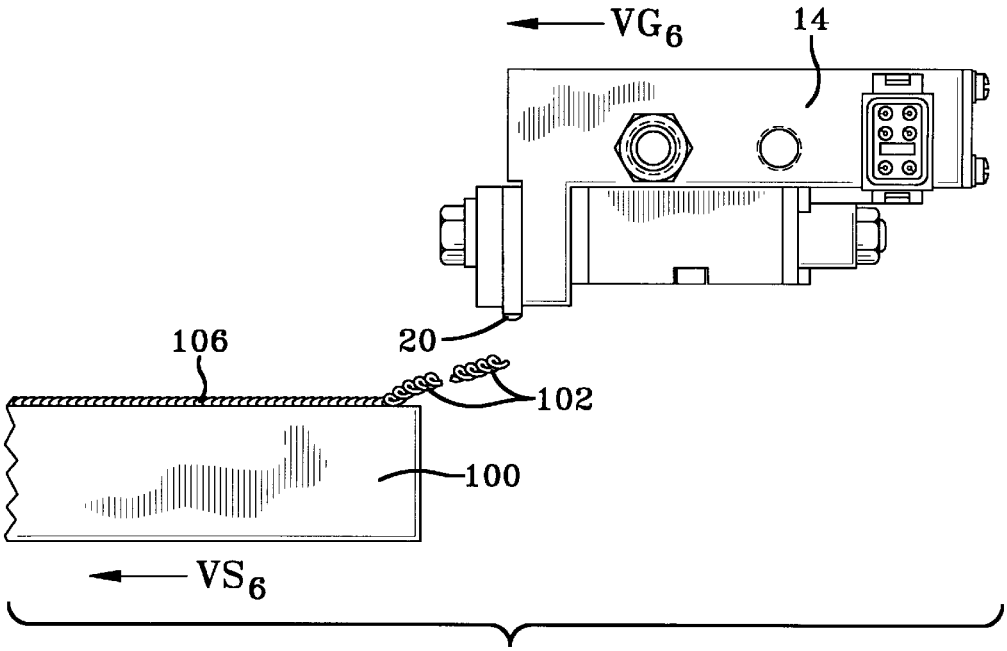

With reference to FIGS. 5 and 6, the string 102 temporarily adheres to the nozzle 20. Because of the difference between VS5 and VG5, the string 102 is stretched and becomes airborne (as is illustrated in FIG. 6), or perhaps is anchored at the end nearest the substrate 100. In either event, the string 102 is not laid on the substrate 100 as is desired. Instead, the string 102 floats somewhere in the manufacturing environment, causing the difficulties already mentioned.

With reference to FIGS. 7–10, the inventive method will be described. Like the prior art method, VS is a positive constant in FIGS. 7–10. However, unlike the prior art, VG varies in the positive and negative directions.

Figure 7:
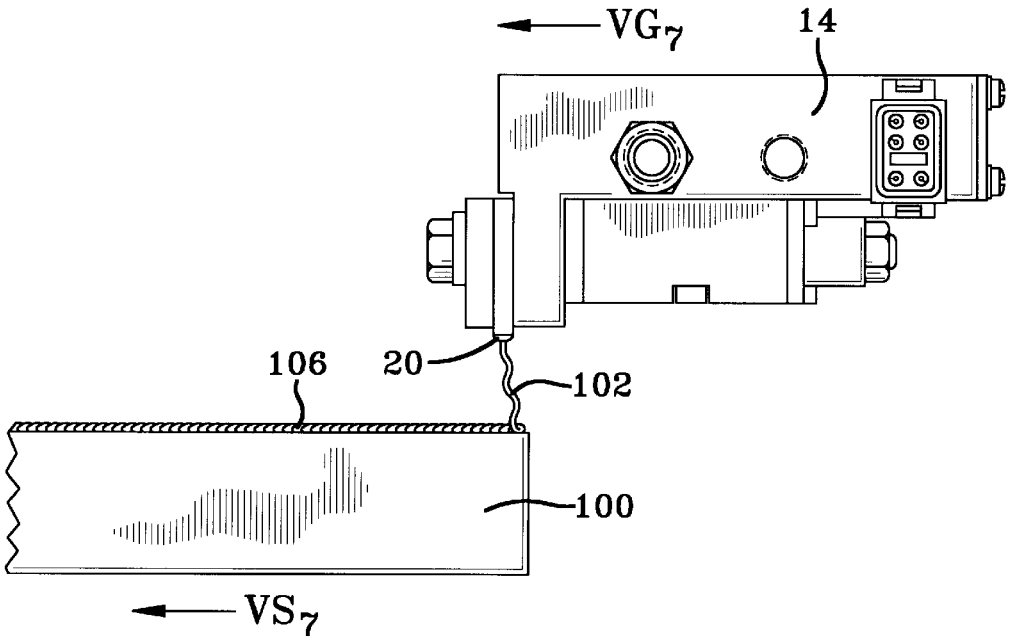
FIGS. 7–10 illustrate the inventive method of applying a bead of material to a substrate without creating a string of adhesive which flies away.

With reference to FIG. 7, the substrate 100, gun 14, bead 106 and string 102 are essentially identical to the prior art system illustrated in FIGS. 3 and 4, with VS7 being a positive constant and VG7 being equal to zero.

Figure 8:
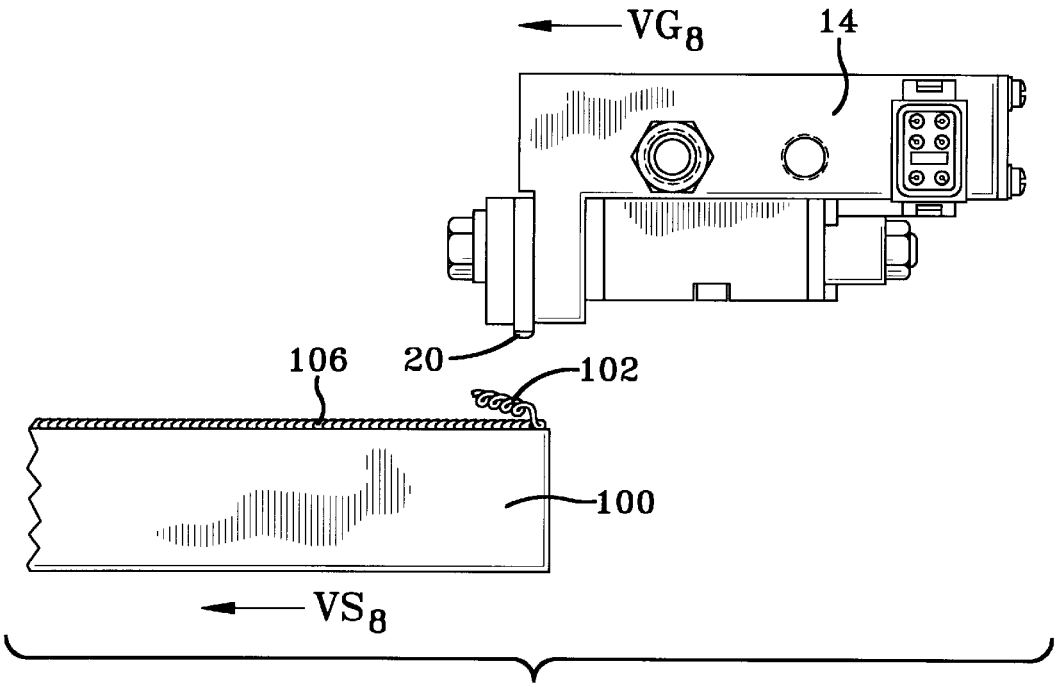

However, with reference to FIG. 8, the gun 14 is moved at a velocity VG8 so that the string 102 snaps back over the substrate 100. Velocity VG8 is equal to VS8, and in the same direction, so that the string 102 never lengthens due to the growing displacement between the substrate 100 and the gun 14. For some materials being applied, the time that the gun 14 travels along with the substrate at the same velocity, i.e., VG8 being equal to VS8, the string 102 becomes more brittle, facilitating the clean break back over the substrate which is illustrated in FIG. 8.

Figure 9:
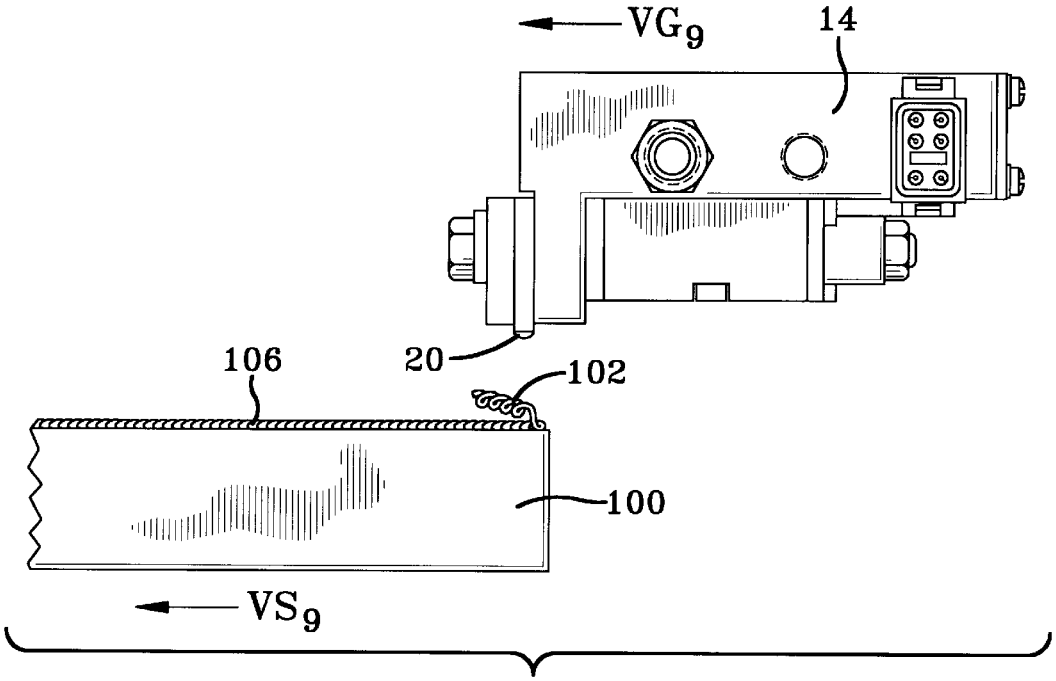
Figure 10:
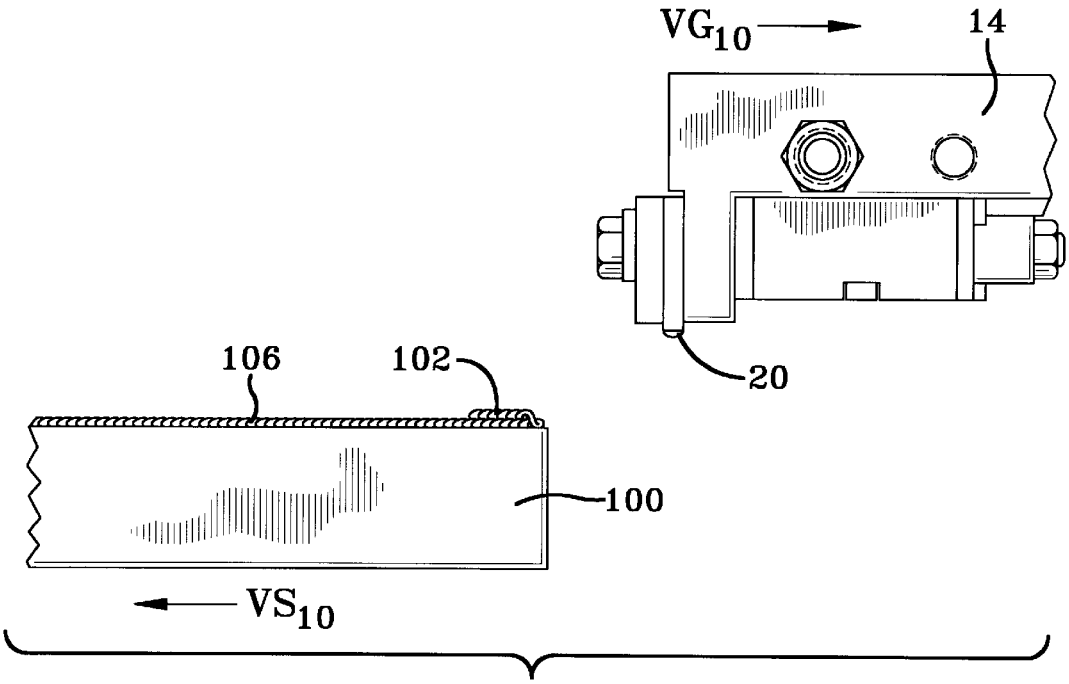

With reference to FIG. 9, in another embodiment of the invention VG9 is greater and in the same direction as VS9. After the string 102 breaks and falls back to the substrate 100, the gun 14 reverses direction and returns to its original start position at velocity VG10, which is in the opposite direction as VS10, as shown in FIG. 10.

In the above-described examples, VS was always in the same direction and a constant velocity, but the invention does not require that situation. As long as the relative velocities VS and VG are such that the string 102 is cleanly broken and/or is laid on the substrate 100, the objects of the invention are accomplished.

In another embodiment, the gun 14 is carried by an arm of an industrial robot (not shown) such as, for example, the type employed in the field of welding or in the assembly of automobiles or other vehicles.

The adhesives used in the above process can fall into two general categories, hot melt adhesives and water-based emulsion adhesives, although the adhesive is not limited to these categories. The preferred adhesive for this invention is a hot melt adhesive due, primarily to, other characteristics of bookbinding such as melt viscosity, set time, cohesive strength and flexibility.

I claim:

1. A method of reducing stringing of a material from a dispensing gun when applying the material to a substrate, the method comprising the steps of:

starting a flow of material from the gun at a starting position;

applying the material to a target location on a moving substrate, thereby creating a first relative motion between the gun and the substrate;

ceasing the flow of the material from the gun while moving the gun in the same direction as the movement of the substrate, causing a second relative motion therebetween such that a string of material is broken and falls onto the target location; and, then returning the gun to the starting position.

2. The method of claim 1 wherein the motion of the gun is substantially equal to the motion of the substrate.

3. The method of claim 1 wherein a velocity of the substrate measured relative to the earth is zero.

4. The method of claim 1 wherein in the second relative motion the motion of the gun is greater than the motion of the substrate.

* * * * *